US012317975B2

(12) United States Patent
Daems

(10) Patent No.: US 12,317,975 B2
(45) **Date of Patent: *Jun. 3, 2025**

(54) EARRING OR BROOCH BACK

(71) Applicant: Guinnot BV, Nijlen (BE)

(72) Inventor: Giovanni Daems, Nijlen (BE)

(73) Assignee: GUINNOT BV, Nijlen (BE)

( * ) Notice: Subject to any disclaimer, the term of this patent is extended or adjusted under 35 U.S.C. 154(b) by 0 days.

This patent is subject to a terminal disclaimer.

(21) Appl. No.: 18/543,642

(22) Filed: Dec. 18, 2023

(65) Prior Publication Data

US 2024/0130487 A1 Apr. 25, 2024

Related U.S. Application Data

(63) Continuation of application No. 17/424,239, filed as application No. PCT/IB2019/059613 on Nov. 8, 2019, now Pat. No. 11,871,819.

(30) Foreign Application Priority Data

Jan. 28, 2019 (BE) ..... 2019/5047

(51) Int. Cl.
*A44C 7/00* (2006.01)
*A44C 1/00* (2006.01)

(52) U.S. Cl.
CPC ..... *A44C 7/003* (2013.01); *A44C 1/00* (2013.01)

(58) Field of Classification Search
CPC ..... A44D 2201/36; Y10T 24/41; A44C 7/003; A44C 1/00
See application file for complete search history.

(56) References Cited

U.S. PATENT DOCUMENTS 1,265,869 A * 5/1918 Arkin ..... A44B 11/266 24/657
1,380,177 A * 5/1921 Arkin ..... A44B 17/0011 24/657

(Continued)

FOREIGN PATENT DOCUMENTS

CN 1369242 A 9/2002
DE 3516622 A1 * 5/1985

(Continued)

OTHER PUBLICATIONS

International Search Report and Written Opinion for the International Patent Application No. PCT/IB2019/059613, mailed Feb. 5, 2020, 9 pages.

*Primary Examiner* — Jack W Lavinder
(74) *Attorney, Agent, or Firm* — KDW Firm PLLC

(57) ABSTRACT

An earring or brooch back for receiving a post includes a housing having a bottom shell and a top shell. The bottom shell and the top shell are provided with mutually aligned openings for forming a passage for the post. A first and a second pressing element are positioned between the bottom shell and the top shell, and the first pressing element is provided with a first stop for the post and a first protruding part which protrudes from the housing. The passage lies between the first stop and the first protruding part, and the second pressing element is provided with a second stop for the post and with a second protruding part which protrudes from the housing. The passage lies between the second stop and the second protruding part, and at least one spring is provided for spring-mounting the first and second pressing element.

19 Claims, 11 Drawing Sheets

(56) References Cited

U.S. PATENT DOCUMENTS

| | | | |
|---|---|---|---|
| 6,557,220 | B1 | 5/2003 | Hamm, Jr. |
| 2010/0122554 | A1 | 5/2010 | Bak |

FOREIGN PATENT DOCUMENTS

| | | | | |
|---|---|---|---|---|
| FR | 2474838 | A1 | * | 2/1980 |
| FR | 2788947 | A1 | | 8/2000 |
| JP | 2003250613 | A | * | 9/2003 |
| KR | 101113143 | B1 | | 2/2012 |
| KR | 20120027609 | A | | 3/2012 |

* cited by examiner

EARRING OR BROOCH BACK

CROSS-REFERENCE TO RELATED APPLICATION

This is a continuation of pending U.S. nonprovisional patent application Ser. No. 17/424,239, filed Jul. 20, 2021, which is a national stage filing under 35 U.S.C. 371 of international patent application PCT/IB2019/059613, filed Nov. 8, 2019, which claims priority to Belgium Patent application serial number 2019/5047, filed Jan. 28, 2019, the entirety of which applications are incorporated by reference herein.

FIELD OF THE INVENTION

The field of the invention relates to earring and brooch backs for receiving a post which is provided with at least one groove, wherein the post can be locked in the back. More specifically, the invention relates to earring and brooch backs comprising a housing with a bottom shell and a top shell, a first and a second pressing element between the bottom shell and the top shell, and at least one spring.

BACKGROUND

Earring backs of the above stated type have existed for many years already. FR 454459 thus describes an earring back with a housing with a bottom shell and a top shell between which two pressing elements are provided. These pressing elements are spring-mounted using two springs. A drawback of the described back is that it comprises many individual parts and that assembly of the back is time-consuming.

Similar systems are further known in which only one M-shaped spring is used for spring-mounting the first and second pressing element, see for instance U.S. Pat. No. 6,557,220 B1. In such systems assembly is however usually also labour-intensive, and there is a risk that the positioning of the different parts will no longer be accurate after a period of time as a result of wear of the spring, which impedes smooth opening and closing of the back.

KR 10-2012-0027609 describes an earring back with a top shell, a bottom shell and two pressing elements which are each provided with a spring element and with a hole for allowing passage of a post.

SUMMARY OF THE INVENTION

The object of embodiments of the present invention is to provide an earring or brooch back of the type stated in the preamble with a limited number of parts and an improved positioning of the parts in the housing, which allows in particular an improved assembly of the back.

According to a first aspect of the invention, an earring or brooch back is provided for receiving a post which is provided with at least one groove. The back comprises a housing with a bottom shell and a top shell, a first and second pressing element between the bottom shell and the top shell, and at least one spring for spring-mounting the first and second pressing element in the housing. The bottom shell and the top shell are provided with mutually aligned openings for forming a passage for the post. The first pressing element is provided with a first stop for the post and a first protruding part which protrudes from the housing, wherein the passage lies between the first stop and the first protruding part. The second pressing element is provided with a second stop for the post and with a second protruding part which protrudes from the housing, wherein the passage lies between the second stop and the second protruding part. The first and second stop lie on either side of a post to be inserted. The bottom shell is preferably formed on the inner side thereof with a first internal guide part for guiding the first pressing element and with a second internal guide part for guiding the second pressing element, wherein the first and second guide part lie on either side of the passage for the post.

By forming the bottom shell with respectively a first and second guide part as described above, placing of the first and second pressing elements during assembly of the back can take place in improved manner, wherein the internal guide parts guarantee a good placing thereof. By forming such guide parts integrally with the bottom shell the number of parts of the back remains limited, while a good positioning and guiding are still obtained.

The first and second pressing element are preferably provided with, and particularly formed with, respectively at least a first and a second guide wall against which the at least one spring acts for the purpose of pressing respectively the first and second protruding part of the first and second pressing element outward. The first guide wall lies substantially between the passage and the first protruding part, and the second guide wall lies substantially between the passage and the second protruding part, such that the distance between the first stop and the second stop can be increased by pressing the first and second protruding part inward.

By providing respectively a first and second guide wall, preferably formed integrally with the first and second pressing element, the at least one spring can be arranged on the first and second pressing element in simple manner during assembly of the back, after the first and second pressing element have been placed in the bottom shell. The first and second guide wall here provide for a good positioning of the spring.

In an exemplary embodiment with a first and second guide wall the first and second pressing element is provided with, preferably formed with, respectively at least a first and second guide groove for the at least one spring. The first guide wall is then formed by a wall of the first guide groove, and the second guide wall is then formed by a wall of the second guide groove. In this way the at least one spring can thus be placed in a groove during assembly, which further simplifies assembly.

According to a preferred embodiment, the first stop lies opposite the second stop as seen in a pressing direction of the first and second pressing element, which pressing direction is perpendicular to an axis of the passage in which the post can be received. When the first and second pressing element are pressed in, the distance between the first and second stop will increase so that a post can be inserted. When the first and second pressing element are released, the first and second stop move toward each other for the purpose of receiving the post therebetween. The first and second stop are preferably arranged symmetrically relative to the axis of the passage. The first and second stop preferably have the same thickness as measured in the direction of the axis of the passage. This thickness is preferably smaller than 0.6 mm, more preferably smaller than 0.5 mm. In the fully pressed-in position the distance between the first and second stop can for instance lie between 1.0 mm and 2.0 mm. In the non-pressed-in position the distance can for instance lie between 0.2 mm and 0.6 mm.

According to a preferred embodiment, the first and second pressing element are embodied such that when the first and second protruding element are pressed inward, the first pressing element comes to a stop against the second stop and the second pressing element comes to a stop against the first stop. In this way the first pressing element thus forms a stop for the second pressing element, and vice versa.

According to a possible embodiment, the bottom shell is provided on an inner side thereof with, and particularly formed with, at least one protruding positioning part for positioning the at least one spring. It is noted here that the positioning part and the above stated first or second guide part can be the same part, this on the one hand having a positioning function for the at least one spring and on the other hand a guiding function for guiding the pressing elements. A positioning and guide part can thus be provided which has a first wall against which the spring is positioned, and a second wall against which a pressing element is positioned. It is however also possible to provide separate parts for positioning the spring and for guiding the pressing elements.

By providing the bottom shell on the inner side thereof with a protruding positioning part, preferably formed integrally with the bottom shell, for positioning the at least one spring the positioning of the at least one spring can be improved further without additional parts being necessary in the back.

In a preferred embodiment the first guide part for guiding the first pressing element has a first guide wall which is parallel to a second guide wall of the second guide part for guiding the second pressing element. The direction of these first and second guide walls is parallel to the pressing direction in which the first and second pressing element are movable. In this way the first and second pressing element can be guided in improved manner, wherein a wall of the first pressing element makes contact with the first guide wall and a wall of the second pressing element makes contact with the second guide wall.

The first and second pressing element, including the possible guide walls, are preferably each formed integrally. The bottom shell, including the optional guide parts and the optional positioning part, is preferably also formed integrally.

In an advantageous embodiment only one spring is accommodated in the housing. In this way the number of parts is limited further. The spring preferably has a first spring-mounted leg against the first guide wall of the first pressing element and a second spring-mounted leg against the second guide wall of the second pressing element. The spring preferably has substantially a V-shape or a U-shape.

According to an embodiment, the first and second leg extend substantially along a circular periphery around the passage P. It is however also possible to give the spring a round U-shape, and the shape thus need not be a perfect circle segment.

According to an embodiment, the spring comprises a spiral-shaped or wave-shaped part which is arranged around or against the positioning part. The first and second leg preferably extend on either side of the spiral-shaped or wave-shaped part. It is however also possible to provide two springs, each provided with a spiral-shaped part, wherein a first spring fulfils the function of the first leg and a second spring fulfils the function of the second leg. In an embodiment the first and second spring-mounted leg and the spiral-shaped or wave-shaped part is formed integrally.

According to a possible embodiment, the first and second guide wall with which the first and second pressing element are equipped are configured to support respectively the first and second leg at one contact point each in the different positions of the first and second pressing elements. This contact point can remain the same in the different positions.

According to an embodiment, the first and second guide wall with which the first and second pressing element are equipped are configured to support respectively the first and second leg at two contact points each in the different positions of the first and second pressing elements. In this way the friction between the first and second guide wall and the first and second leg can be limited in some embodiments, which results in a smoother opening and closing of the back.

According to a preferred embodiment, the first pressing element extends substantially U-shaped around the passage with a first leg which forms the first stop. The second pressing element can also extend substantially U-shaped around the passage with a second leg which forms the second stop. The first leg lies partially in the U-shaped part of the second pressing element and the second leg lies partially in the U-shaped part of the first pressing element, such that the first and second pressing element hook into each other, as it were.

According to a possible embodiment, the at least one positioning part for the at least one spring comprises a pin. It is particularly when the spring is provided with a spiral-shaped or wave-shaped part that this spiral-shaped or wave-shaped part can be arranged around the pin. It is however also possible to provide the positioning part with a deepened portion or recess in which a part of the spring, for instance the spiral-shaped or wave-shaped part, can be received.

According to a preferred embodiment, the spring is a wire spring. Such springs can be obtained in simple manner and are robust. The spring is preferably manufactured from metal, for instance titanium. The diameter of the spring is preferably smaller than 1 mm, more preferably smaller than 0.5 mm. The length of the spring preferably lies between 7 and 10 mm, more preferably between 6 and 11 mm. The diameter of the bottom shell preferably lies between 5 mm and 9 mm, more preferably between 6 mm and 8 mm.

According to an advantageous embodiment, the bottom shell is provided with a first and a second stepped peripheral part on which the top shell is mounted. The first and second pressing element extend between the first and second stepped peripheral part. It is however also possible to provide peripheral parts which are not stepped. Giving the peripheral parts a stepped form however enables the top shell to be positioned and mounted in simpler manner.

According to another aspect of the invention, a method is provided for manufacturing an earring or brooch back of the type stated in the preamble. The method comprises the following steps of:

- providing a bottom shell and a top shell, wherein the bottom shell and the top shell are provided with mutually aligned openings for forming a passage for the post;
- arranging a first and second pressing element in the bottom shell, wherein the first pressing element is provided with a first stop for the post, and a first protruding part which protrudes from the bottom shell, wherein the passage lies between the first stop and the first protruding part, and wherein the pressing element is provided with a second stop for the post and with a second protruding part which protrudes from the bottom shell, wherein the passage lies between the second stop and the second protruding part, and wherein the first and second stop lie on either side of a post to be inserted;
- arranging at least one spring in a compressed state on the first and second pressing element such that the at least one spring acts against the first and second pressing element and presses them outward;

arranging the top shell over the at least one spring and connecting the top shell to the bottom shell.

The preferred and exemplary features described above with reference to the back likewise apply to the method.

The top shell and/or the bottom shell are preferably manufactured from metal by turning and/or milling.

The first and the second pressing element are preferably manufactured by lasering.

When the bottom shell is formed on the inner side thereof with a first and a second internal guide part for guiding respectively the first and the second pressing element, as described above, the first and second pressing element will preferably be arranged during the above described method such that they make contact with the first and second guide part.

When the bottom shell is formed on an inner side thereof with at least one protruding positioning part for positioning the at least one spring, the at least one spring will preferably be arranged on the first and second pressing element such that the at least one spring supports against the positioning part. When the first and second pressing element are formed with respectively a first and second guide wall, the at least one spring is preferably arranged such that it acts for the purpose of pressing respectively the first and second protruding part outward, wherein the first guide wall lies substantially between the passage and the first protruding part and the second guide wall lies substantially between the passage and the second protruding part, such that the distance between the first and the second stop can be increased by the action of the spring against the first and second guide wall.

According to a further aspect of the invention, an earring or brooch back is provided for the purpose of receiving a post which is provided with at least one groove, comprising: a housing comprising a bottom shell and a top shell, wherein the bottom shell and the top shell are provided with mutually aligned openings for forming a passage for the post; a first and a second pressing element between the bottom shell and the top shell, wherein the first pressing element is provided with a first stop for the post and a first protruding part which protrudes from the housing, wherein the passage lies between the first stop and the first protruding part, and wherein the second pressing element is provided with a second stop for the post and with a second protruding part which protrudes from the housing, wherein the passage lies between the second stop and the second protruding part, wherein the first and second stop lie on either side of a post to be inserted; at least one spring for spring-mounting the first and second pressing element;

wherein the bottom shell is provided on an inner side thereof with, and is preferably formed with, at least one protruding positioning part for positioning the at least one spring; and/or wherein the first and the second pressing element are provided with, and preferably formed with, respectively at least a first and a second guide wall against which the at least one spring acts for the purpose of pressing respectively the first and second protruding part outward, which first guide wall lies substantially between the passage and the first protruding part and which second guide wall lies substantially between the passage and the second protruding part, such that the distance between the first stop and the second stop can be increased by pressing the first and second protruding part inward.

Note that providing a protruding positioning part for the spring in the bottom shell is optional. In some embodiments the spring is arranged tensioned between the two pressing elements, wherein the spring is also tensioned in the uncompressed state. By giving the pressing elements a suitable form, the spring can then remain in place without additional positioning parts being necessary on the inner side of the bottom shell.

BRIEF DESCRIPTION OF THE FIGURES

The above stated and other advantageous features and objects of the invention will become more apparent, and the invention better understood, on the basis of the following detailed description when read in combination with the accompanying drawings, in which.

DETAILED FIGURE DESCRIPTION

Figure 1A:
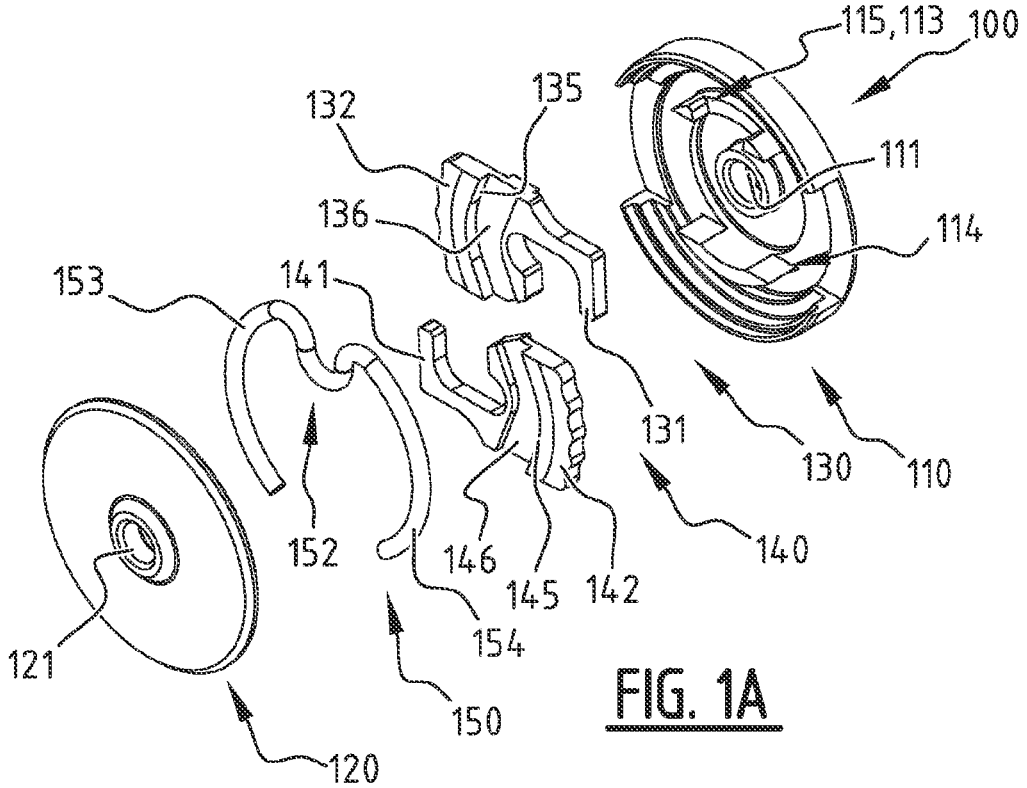
FIG. 1A is a schematic cut-away perspective view of a first embodiment of a back.

FIGS. 1A, 1B, 1C, 2A, 2B, 3A, 3B, 4A, 4B illustrate a first embodiment of an earring back 100 according to the invention. Earring back 100 is intended for the purpose of receiving a post 200 with at least one groove 210. Earring back 100 comprises a housing with a bottom shell 110 and a top shell 120, a first and a second pressing element 130, 140 between the bottom shell and the top shell, and a spring 150 for spring-mounting the first and second pressing element.

Bottom shell 110 and top shell 120 are provided with mutually aligned openings 111, 121 for forming a passage P for post 200. First pressing element 130 is provided with a first stop 131 for post 200 and a first protruding part 132 which protrudes from the housing, wherein the passage P lies between first stop 131 and first protruding part 132. The second pressing element 140 is provided with a second stop 141 for post 200 and with a second protruding part 142 which protrudes from the housing, wherein the passage P lies between second stop 141 and second protruding part 142. The first and second stop lie on either side of a post 200 to be inserted, and are intended to engage in groove 210.

Bottom shell 110 is formed on the inner side with a first internal guide part 113 for guiding first pressing element 130 and with a second internal guide part 114 for guiding the second pressing element 140, wherein the first and second internal guide part 113, 114 lie on either side of the passage for the post. Bottom shell 110 is further provided on an inner side thereof with, and preferably formed with, a protruding positioning part 115 for positioning the at least one spring 150. In the shown embodiment guide part 113 and positioning part 115 are mutually adjoining, wherein guide walls 113' fulfil a guiding function of the pressing elements and positioning walls 115' fulfil the positioning function. The first internal guide part 113 has a first guide wall 113' which is parallel to a second guide wall 114' of the second internal guide part 114, and is parallel to the pressing/pushing direction in which the first and second pressing elements can be pressed/pushed inward.

The first and the second pressing element 130, 140 are provided with, and preferably formed with, respectively at least a first and a second guide wall 135, 145 against which the at least one spring acts for the purpose of pressing respectively the first and second protruding part outward. First guide wall 135 lies substantially between the passage P and first protruding part 132 and second guide wall 145 lies substantially between the passage P and second protruding part 142, such that the distance d between first stop 131 and second stop 141 can be increased by pressing the first and second protruding part 132, 142 inward.

The first and the second pressing element 130, 140 are provided with, and preferably formed with, respectively at least a first and a second guide groove 136, 146 for the spring 150. The first guide wall 135 is a wall of the first guide groove 136 and the second guide wall 145 is a wall of the second guide groove 146.

The first and second pressing element 130, 140 are each formed integrally. Bottom shell 110, including the first and second internal guide part 113, 114 and the positioning part 115, are also formed integrally.

Spring 150 comprises a first spring-mounted leg 153 against first guide wall 135 and a second spring-mounted leg 154 against second guide wall 145. First and second leg 153, 154 extend substantially along a circular periphery or round U-shape around the passage P. Spring 150 comprises a wave-shaped part 152 which is arranged against positioning part 115. First and second spring-mounted leg 153, 154 and wave-shaped part 152 are formed integrally. First and second guide wall 135, 145 are configured to support first and second leg 153, 154 at two contact points P1, P2 each in the different positions of the first and second pressing elements 130, 140. Protruding positioning part 115 comprises a recess with positioning walls 115' in which a part of spring 150 is received. Spring 150 is a wire spring.

First pressing element 130 extends substantially U-shaped around the passage with a first leg which forms the first stop 131. Second pressing element 140 extends substantially U-shaped around the passage with a second leg which forms the second stop 141. First leg 131 lies partially in the U-shaped part of second pressing element 140 and second leg 141 lies partially in the U-shaped part of first pressing element 130.

First stop 131 lies opposite second stop 141 as seen in a pressing direction of the first and second pressing element 130, 140, which pressing direction is perpendicular to an axis of the passage P in which the post can be received. When the first and second pressing element 130, 140 are pressed in, the distance between the first and second stop 131, 141 will increase so that a post 200 can be inserted. When first and second pressing element 130, 140 are released, first and second stop 131, 141 move toward each other for fixedly clamping post 200 therebetween. First and second stop 131, 141 are preferably arranged symmetrically relative to the axis of the passage P. First and second stop 131, 141 preferably have the same thickness as measured in the direction of the axis A of the passage. First and second pressing element 130, 140 are embodied such that when the first and second protruding element are pressed inward, first pressing element 130 comes to a stop against second stop 141 and second pressing element 140 comes to a stop against first stop 131.

Bottom shell 110 is provided with a first and a second stepped peripheral part 116, 117 on which top shell 120 is mounted. First and second pressing element 130, 140 extend between the first and second stepped peripheral part 116, 117.

Earring back 100 according to the first embodiment can be assembled by means of the following steps:

- providing bottom shell 110 and top shell 120;
- arranging a first and a second pressing element 130, 140 in the bottom shell between the first and second internal guide part 113, 114;
- arranging spring 150, in a compressed state, on the first and second pressing element such that the spring acts against the first and the second pressing element and presses them outward;
- arranging the top shell over the spring and connecting the top shell to the bottom shell.

The top shell and the bottom shell can be manufactured from metal by turning and/or milling. The first and the second pressing element can be manufactured by lasering.

The spring 150 is arranged against the at least one protruding positioning part 115, and spring 150 is arranged on the first and second pressing element such that the spring acts against the first and the second guide wall and presses them outward.

FIGS. 5A, 5B, 5C, 6A, 6B, 7A, 7B, 8A, 8B illustrate a second embodiment of a back according to the invention. The back according to the second embodiment is similar to the back according to the first embodiment, with the difference that the positioning element for positioning the spring is formed by a pin, wherein a spiral-shaped part 151 is arranged around the pin. The other parts of the back are identical or similar and will not be described again.

Figure 9:
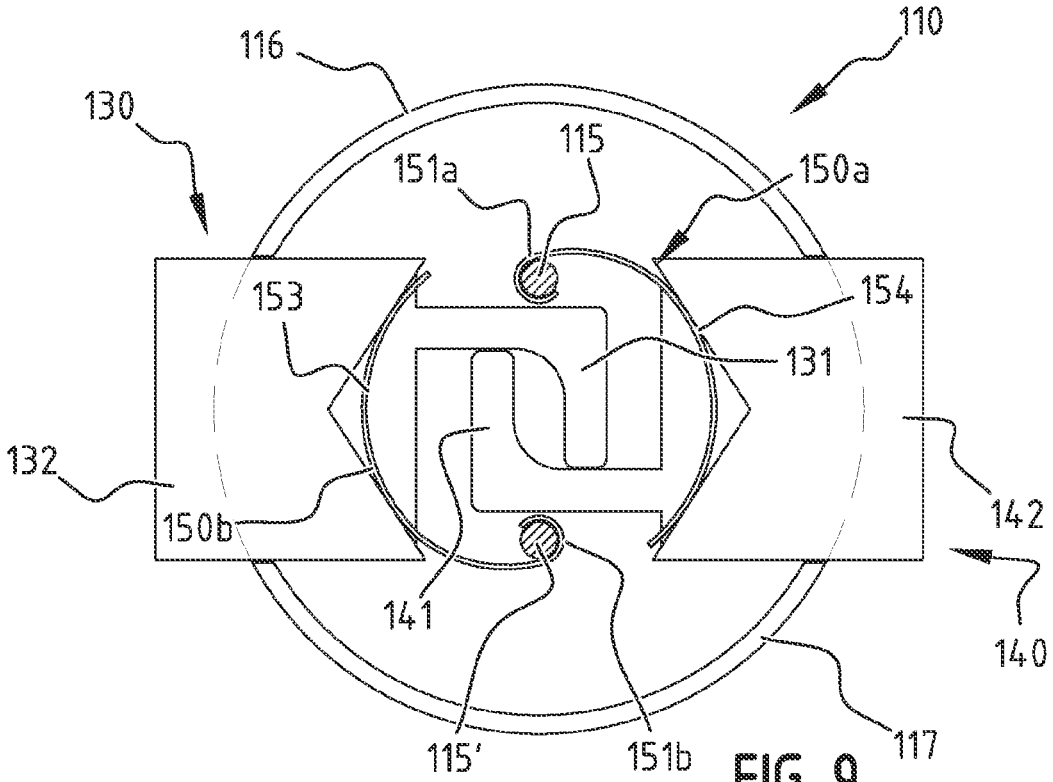
FIG. 9 illustrates a schematic top view of a third embodiment of a back.

FIG. 9 illustrates a third embodiment of a back. Once again, similar parts are designated with the same reference numerals, and only the differences will be discussed below. In the back of FIG. 9 two springs 150*a*, 150*b* are provided instead of one spring. The two springs are provided with a spiral-shaped part 151*a*, 151*b*. In this embodiment the first and second pressing element are guided only by the peripheral parts 116, 117, and no internal guide parts are provided. The skilled person will however appreciate that these can be added so as to further improve the guiding. The skilled person will further appreciate that the two springs of the embodiment of FIG. 9 can fulfil the same function as the singular spring of the first and second embodiment.

Figure 10:
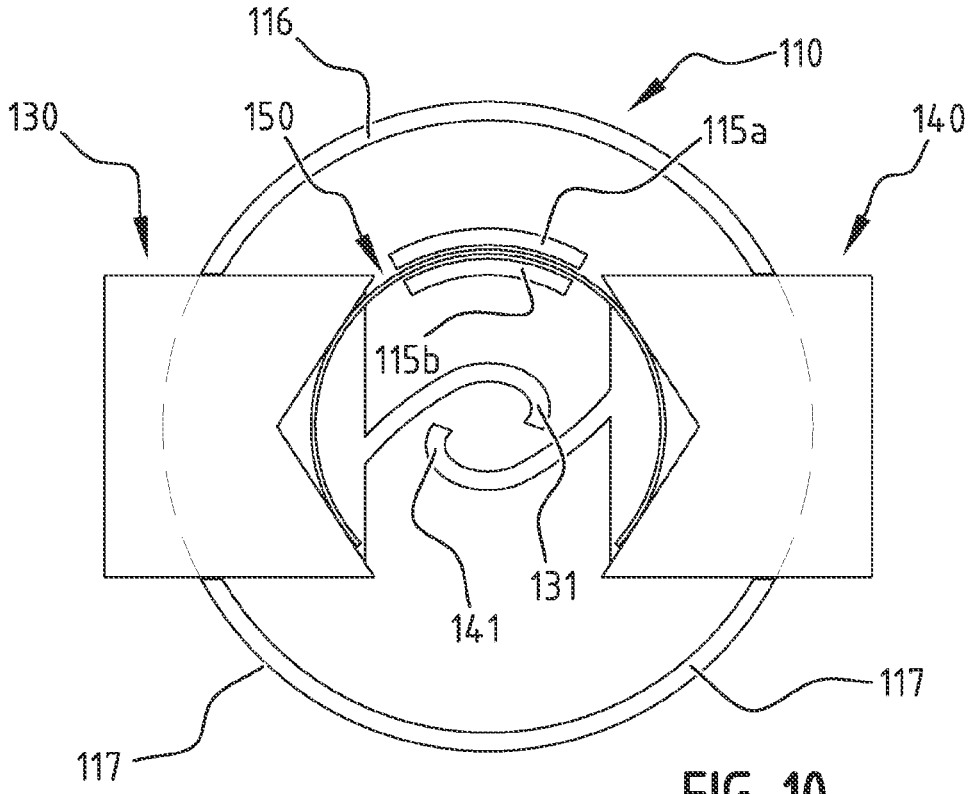
FIG. 10 illustrates a schematic top view of a fourth embodiment of a back.
Figure 11:
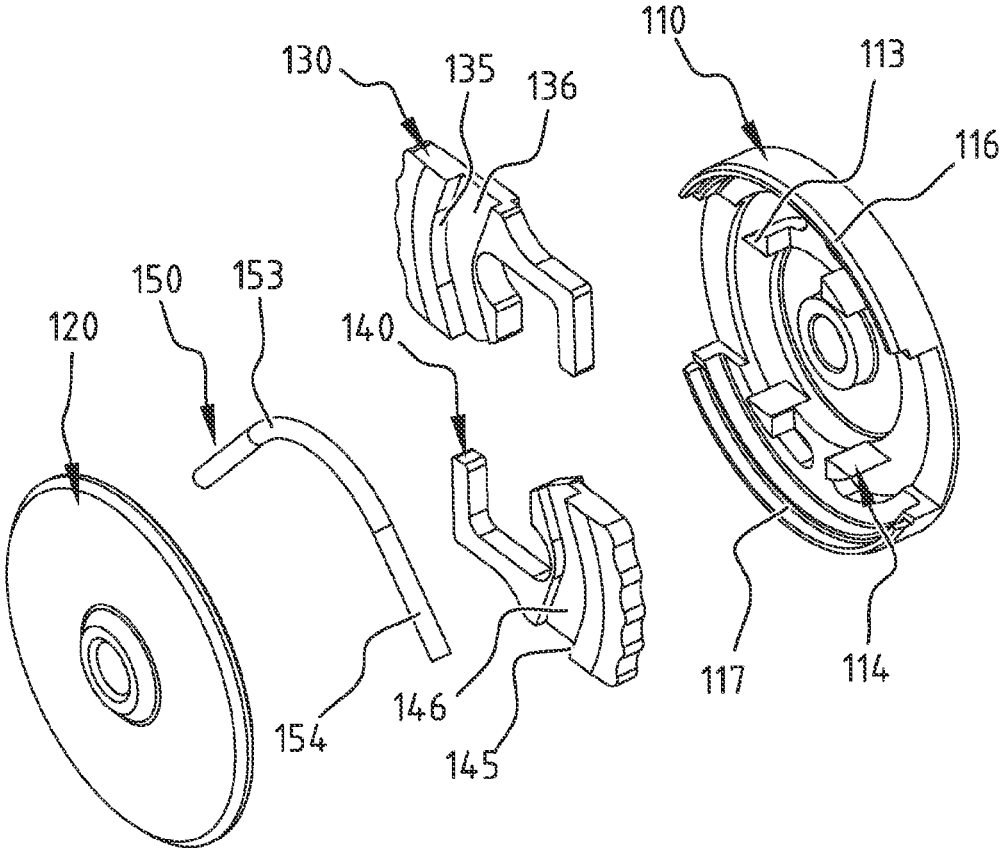
FIG. 11 is a schematic cut-away perspective view of a fifth embodiment of a back.

FIG. 10 shows a fourth embodiment of a back. In the embodiment of FIG. 10 one single spring 150 is used, which has the shape of a round U. Two positioning elements 115*a*, 115*b* are provided for the purpose of positioning the spring 150. These positioning elements 115*a*, 115*b* are formed integrally with bottom shell 110. The first and second pressing element are here also guided only by peripheral parts 116, 117. The skilled person will however appreciate that, as in the first embodiment and the second embodiment, at least two additional internal guide elements are preferably provided for the purpose of guiding the movement of the first and second pressing element 130, 140.

Figure 1B:
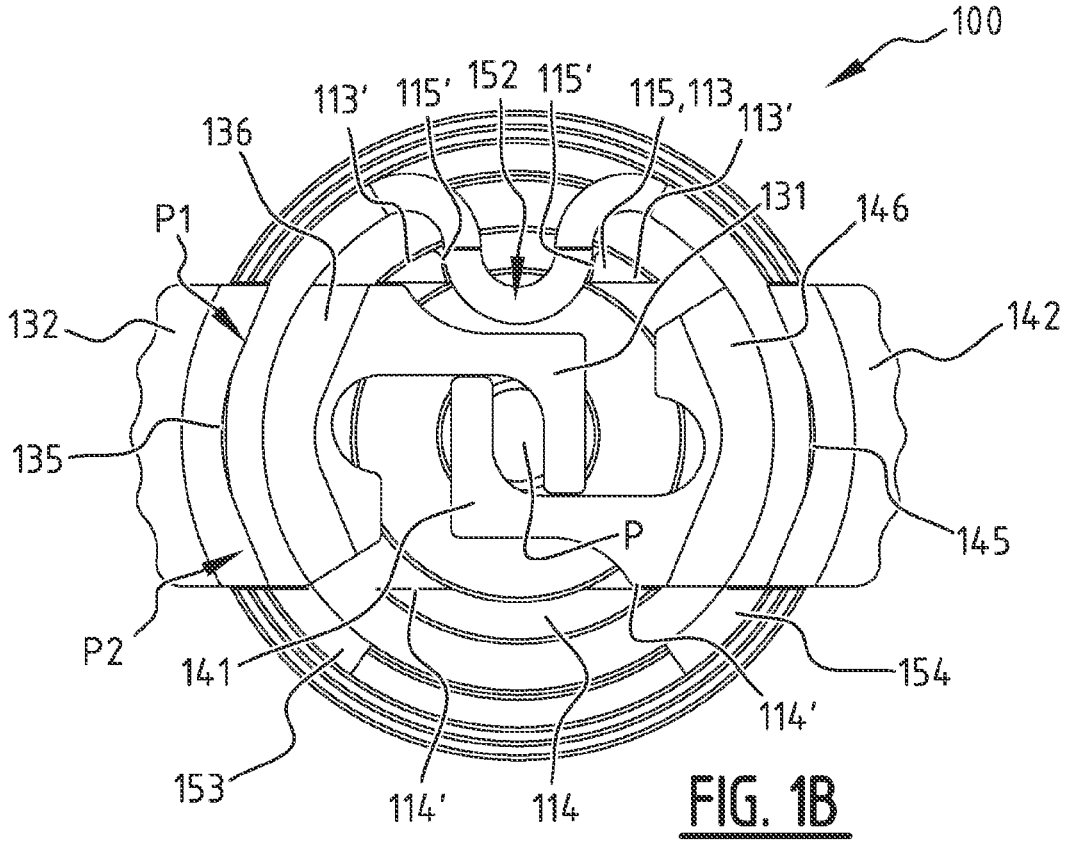
FIG. 1B is a top view of the back of FIG. 1A without the top shell.
Figure 1C:
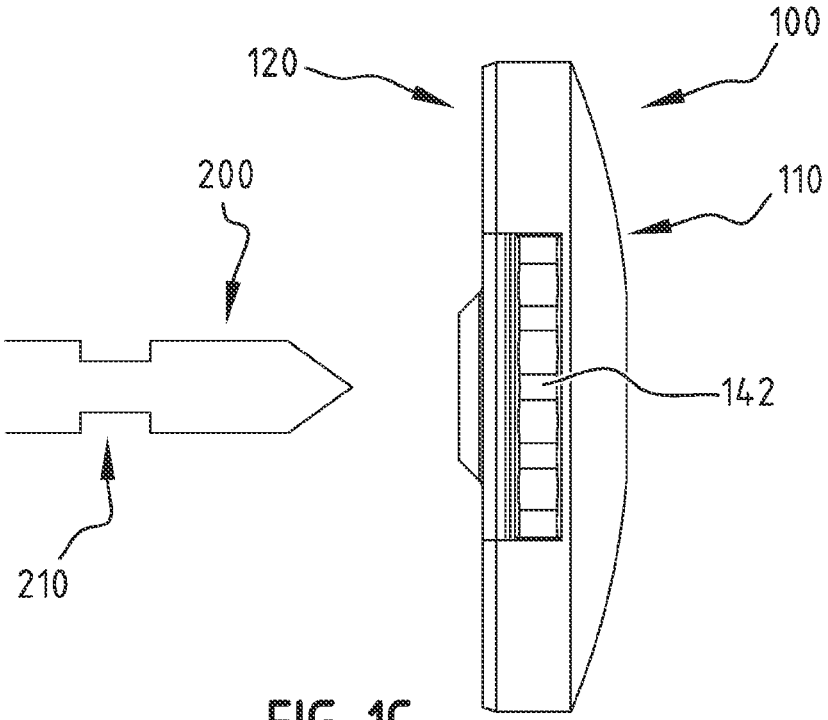
FIG. 1C is a side view of the back of FIG. 1A.
Figure 2A:
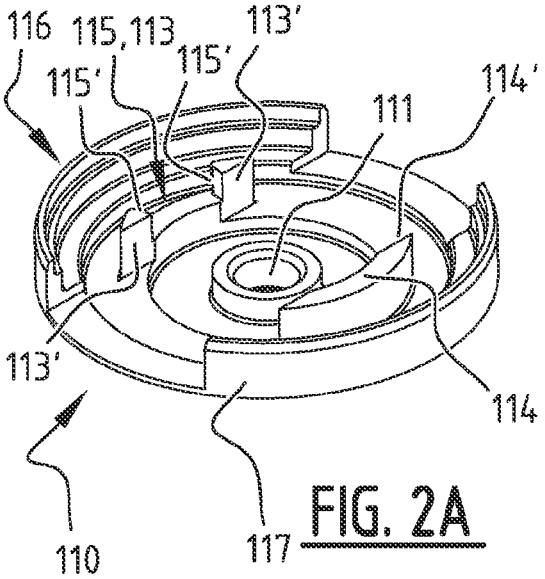
FIGS. 2A and 2B are respective perspective views of the bottom shell of FIG. 1A, looking at an inner side and at an outer side.
Figure 2B:
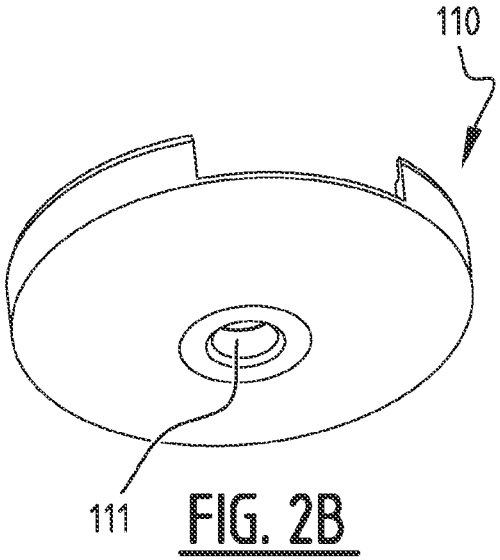
Figure 3A:
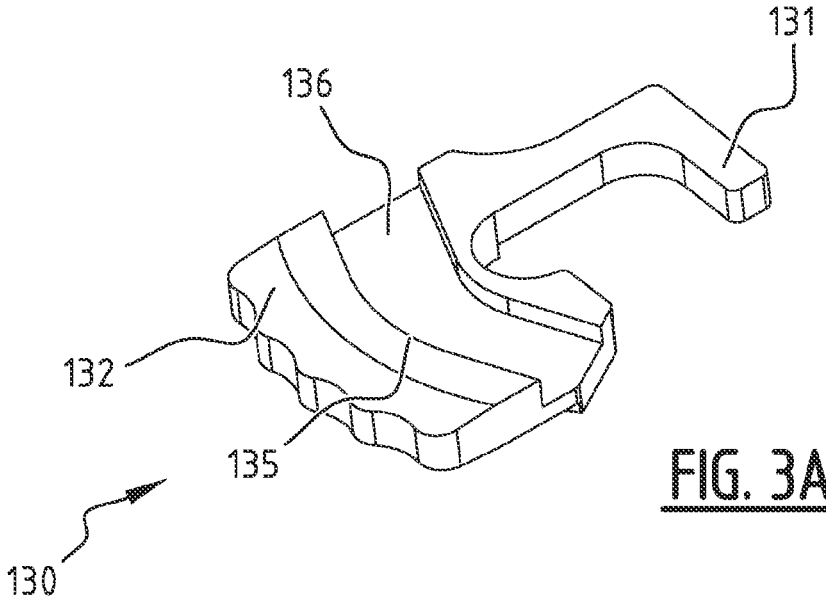
FIGS. 3A and 3B are schematic perspective views of a first pressing element of the back of FIG. 1A, looking at respectively an upper and an underside.
Figure 3B:
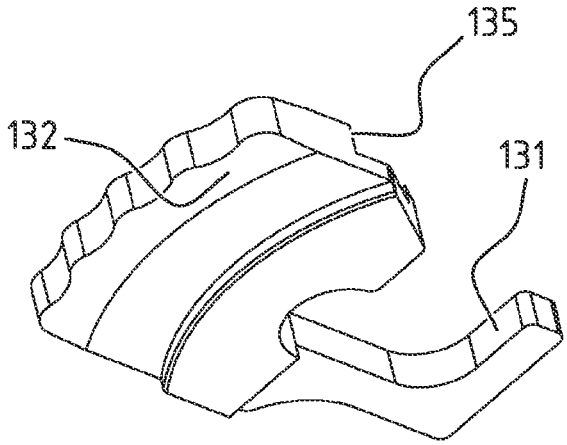
Figure 4A:
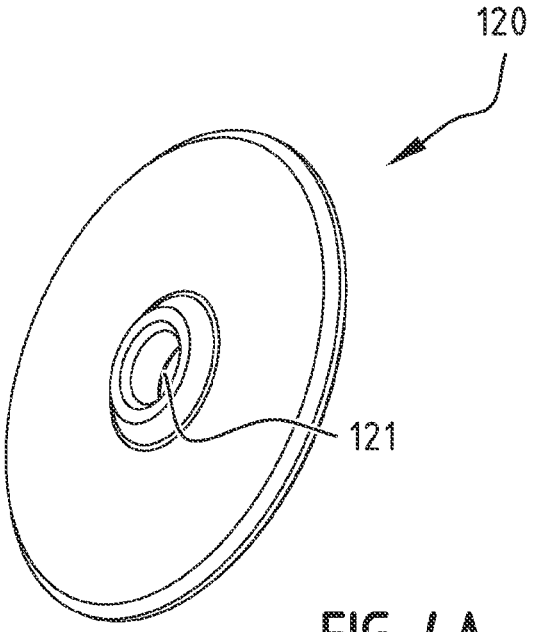
FIGS. 4A and 4B are respective schematic perspective views of the top shell of the back of FIG. 1A, looking at respectively an upper side and an underside.
Figure 4B:
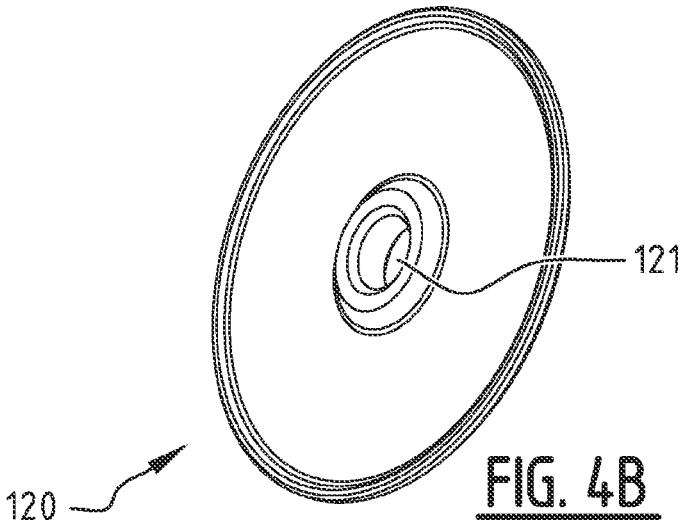
Figure 5A:
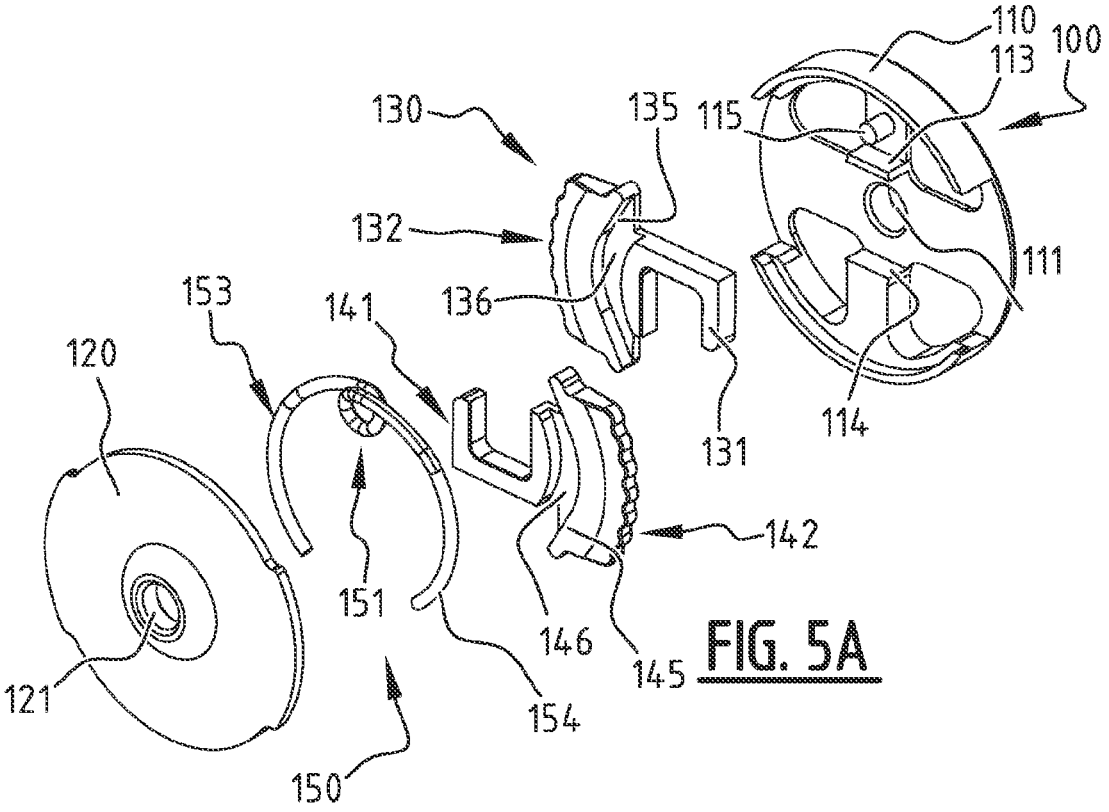
FIG. 5A is a schematic cut-away perspective view of a second embodiment of a back.
Figure 5B:
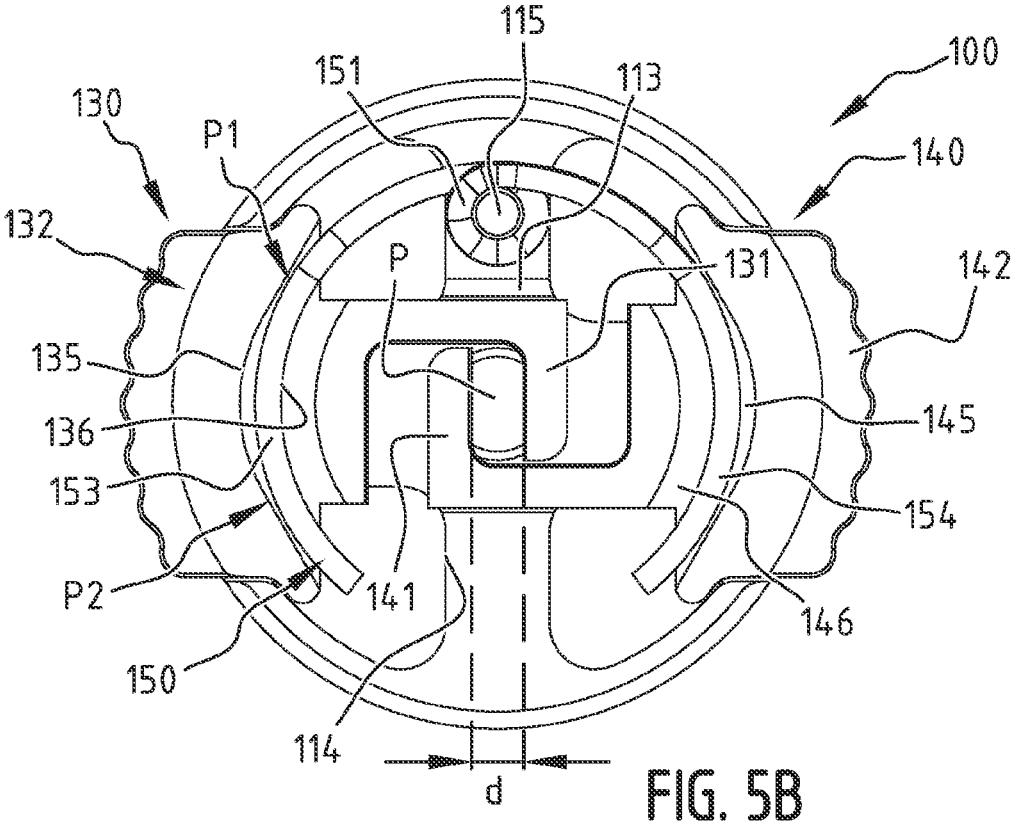
FIG. 5B is a top view of the back of FIG. 1A without the top shell.
Figure 5C:
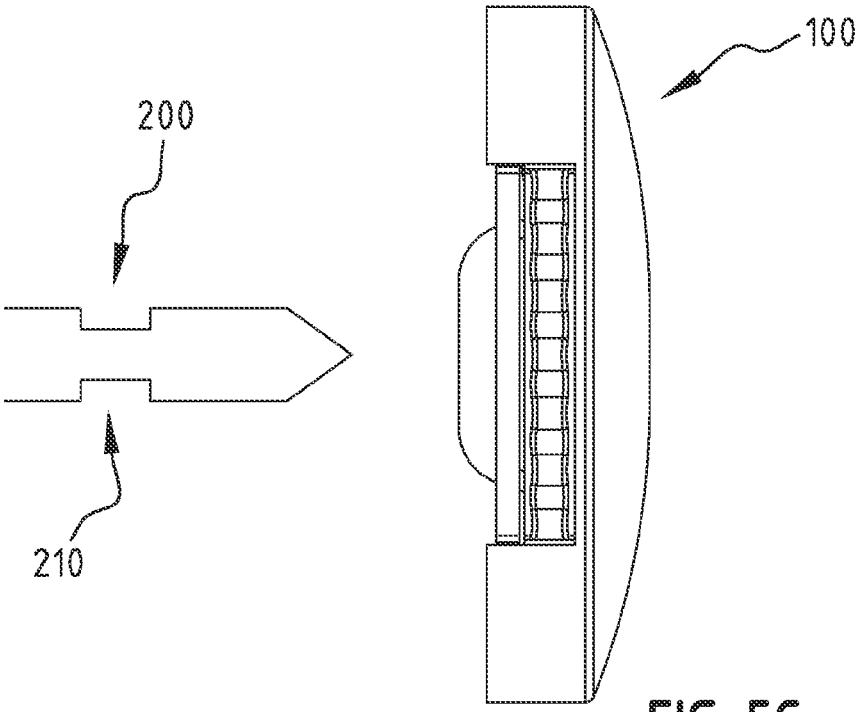
FIG. 5C is a side view of the back of FIG. 5A.
Figure 6A:
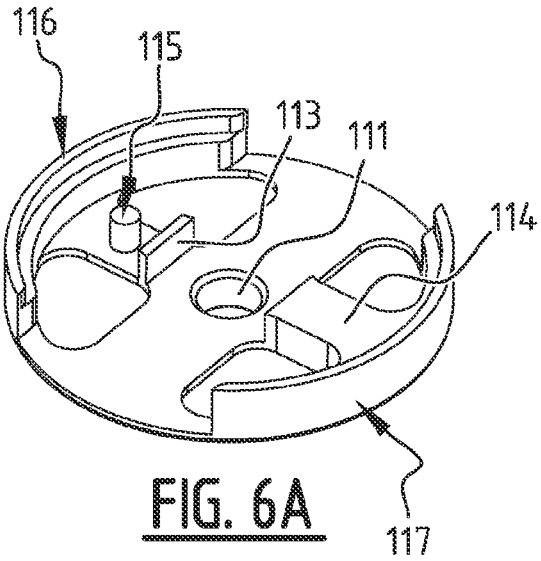
FIGS. 6A and 6B are respective perspective views of the bottom shell of FIG. 5A, looking at an inner side and at an outer side.
Figure 6B:
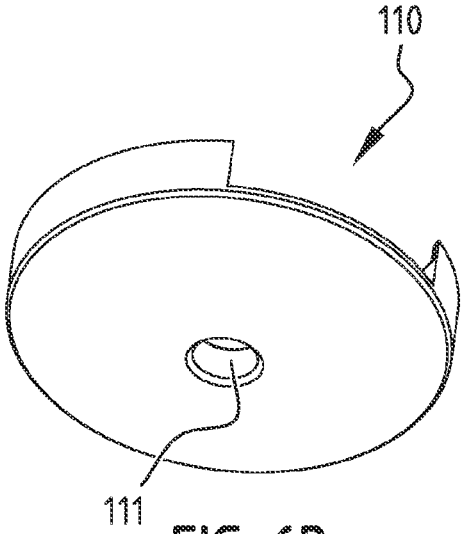
Figure 7A:
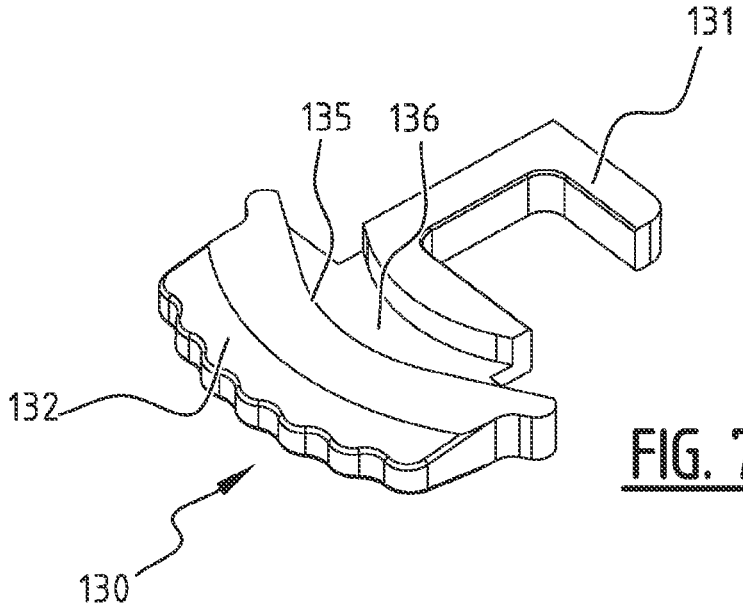
FIGS. 7A and 7B are schematic perspective views of a first pressing element of the back of FIG. 5A, looking at respectively an upper and an underside.
Figure 7B:
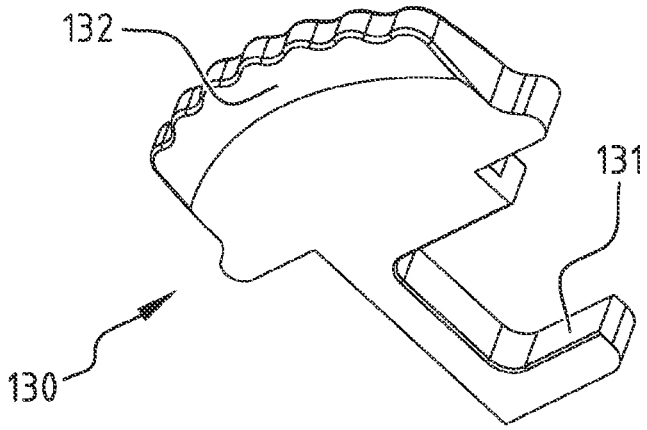
Figure 8A:
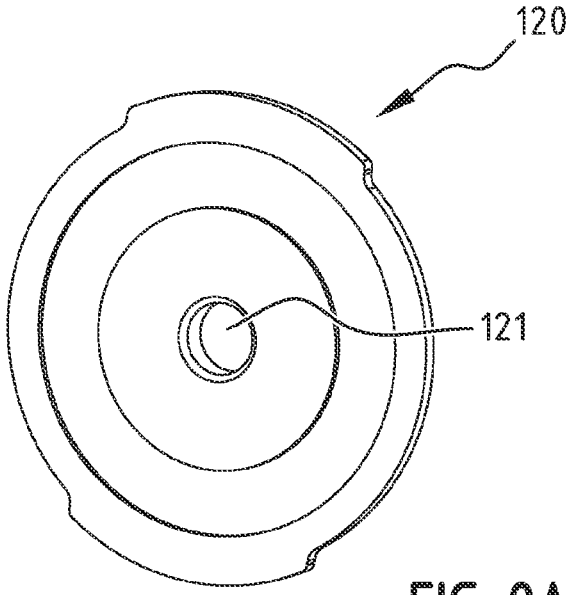
FIGS. 8A and 8B are respective schematic perspective views of the top shell of the back of FIG. 5A, looking at respectively an upper side and an underside.
Figure 8B:
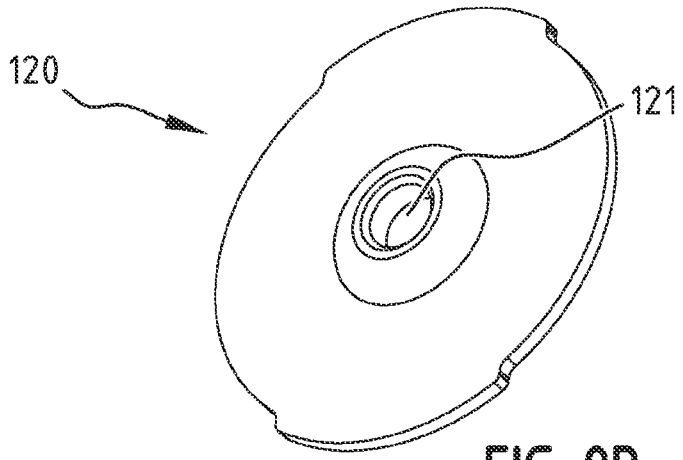

FIGS. 11, 12A and 12B, 13A and 13B illustrate schematically a fifth embodiment of a back, which is similar to the embodiment of FIGS. 1A-1C. Similar components are designated with the same reference numerals and will not be further elucidated here.

As can be clearly seen in FIGS. 12A and 12B and 13A and 13B, first stop 131 lies opposite second stop 141 as seen in a pressing direction R of the first and second pressing element 130, 140, which pressing direction R is perpendicular to an axis A of the passage P in which the post can be received. When first and second pressing element 130, 140 are pressed in, the distance between the first and second stop 131, 141 will increase so that a post 200 can be inserted. When first and second pressing element 130, 140 are released, first and second stop 131, 141 move toward each other for fixedly clamping the post therebetween. First and second stop 131, 141 are preferably arranged symmetrically relative to the axis of the passage P. Upper surface 131*a*, 141*a* of first and second stop 131, 141 preferably lie in the same plane. The lower surface 131*b*, 141*b* of the first and second stop 131, 141 preferably also lie in the same plane. First and second stop 131, 141 preferably have the same thickness d as measured in the direction of the axis A of the passage P, see FIGS. 13A and 13B. This thickness d is preferably smaller than 0.6 mm, more preferably smaller than 0.5 mm. In the fully pressed-in position the distance a2 between the first and second stop 131, 141 can for instance lie between 1.0 mm and 2.0 mm, see FIG. 12B. In the non-pressed-in position the distance a1 can for instance lie between 0.2 mm and 0.6 mm, see FIG. 12A.

Figure 12B:
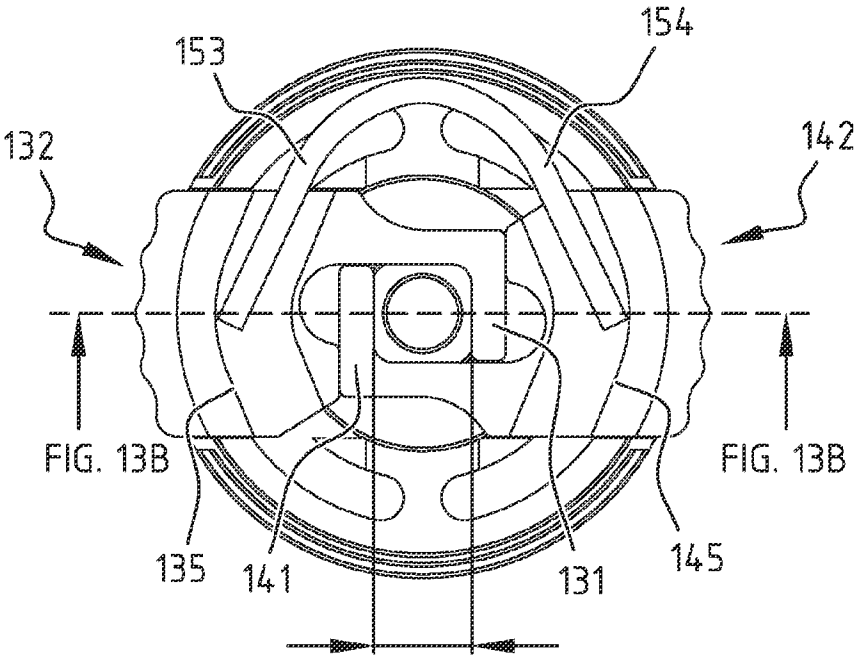
FIGS. 12A and 12B are schematic top views of the back of FIG. 11 without the top shell, respectively in the non-pressed-in position and in the pressed-in position.
Figure 13B:
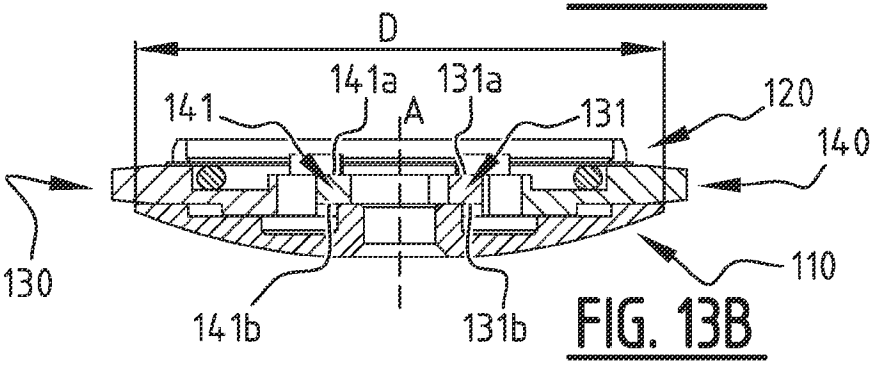
FIGS. 13A and 13B are schematic cross-sections of the back of FIG. 11, respectively in the non-pressed-in position and in the pressed-in position.
Figure 12A:
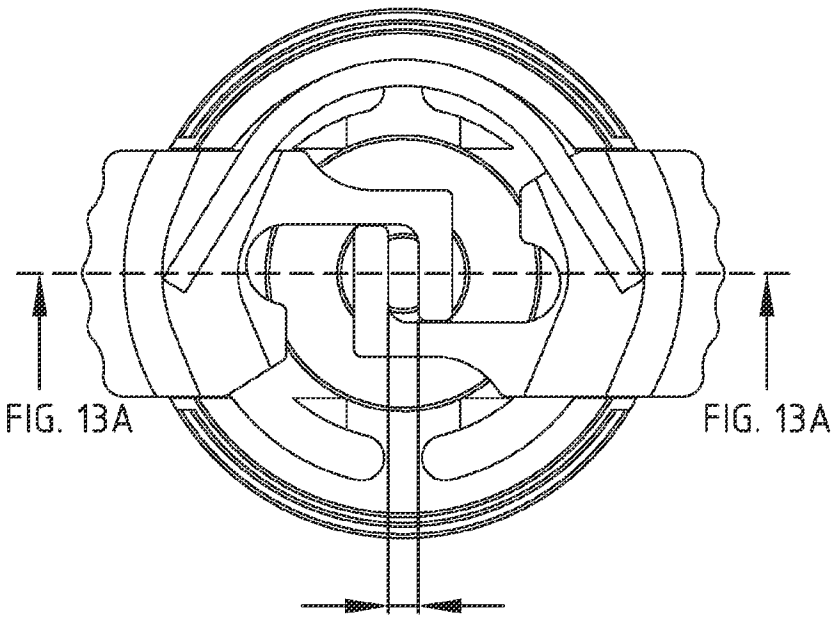
Figure 13A:
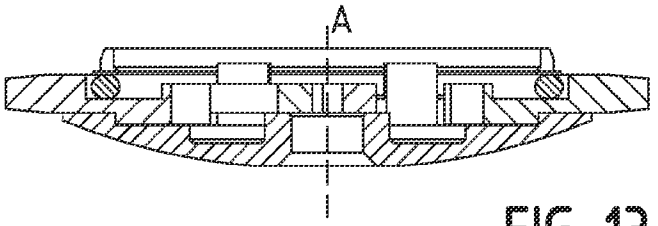

The first and second pressing element 130, 140 are embodied such that when the first and second protruding element are pressed inward, first pressing element 130 comes to a stop against second stop 141 and second pressing element 140 comes to a stop against first stop 131, see FIG. 12B. More specifically, first stop 131 has an inner side which is directed toward the passage and is intended to come into contact with a post 200, and an outer side which is directed toward the protruding part 142 of second pressing element 140, wherein the outer side of first stop 131 is intended to form a stop for second pressing element 140. The same applies to the second stop 141, wherein second stop 141 has an outer side which is directed toward the protruding part 132 of first pressing element 130, wherein the outer side of second stop 141 is intended to form a stop for the first pressing element 130.

Spring 150 comprises a first spring-mounted leg 153 against first guide wall 135 and a second spring-mounted leg 154 against second guide wall 145. First and second leg 153, 154 extend substantially V-shaped around the passage P. Spring 150 is preferably manufactured from metal, for instance titanium. The diameter of spring 150 is preferably smaller than 1 millimetre, more preferably smaller than 0.5 mm. The length of the spring preferably lies between 7 and 10 mm, more preferably between 6 and 11 mm. The diameter D of the bottom shell preferably lies between 5 mm and 9 mm, more preferably between 6 mm and 8 mm.

The skilled person will appreciate that the invention is not limited to the above described embodiments and that many modifications and variants are possible within the scope of the invention, which is defined solely by the following claims.

The invention claimed is:

1. An earring or brooch back for receiving a post which is provided with at least one groove, comprising:

a housing comprising a bottom shell and a top shell, wherein the bottom shell and the top shell are provided with mutually aligned openings for forming a passage for the post;

a first and a second pressing element between the bottom shell and the top shell, wherein the first pressing element is provided with a first stop for the post and a first protruding part which protrudes from the housing, wherein the passage lies between the first stop and the first protruding part, and wherein the second pressing element is provided with a second stop for the post and with a second protruding part which protrudes from the housing, wherein the passage lies between the second stop and the second protruding part, wherein the first and second stop lie on either side of a post to be inserted; and at least one spring for spring-mounting the first and second pressing element;

wherein the bottom shell is formed on an inner side with a first internal guide part for guiding the first pressing element and with a second internal guide part for guiding the second pressing element, wherein the first and second internal guide part lie on either side of the passage for the post;

wherein the first and the second pressing element are provided with, respectively at least a first and a second guide wall against which the at least one spring acts for the purpose of pressing respectively the first and second protruding part outward; and wherein the first and the second pressing element are formed with, respectively at least a first and a second guide groove for the at least one spring, said first and second groove each being delimited by a bottom wall and two side walls, wherein the first guide wall is a side wall of the first guide groove and the second guide wall is a side wall of the second guide groove.

2. The earring or brooch back according to claim 1, wherein the first guide wall lies substantially between the passage and the first protruding part and which second guide wall lies substantially between the passage and the second protruding part, such that the distance between the first stop and the second stop can be increased by pressing the first and second protruding part inward.

3. The earring or brooch back according to claim 1, wherein the at least one spring has a first spring-mounted leg against the first guide wall and a second spring-mounted leg against the second guide wall.

4. The earring or brooch back according to claim 3, wherein the first and second leg extend substantially along a V-shape or a U-shape around the passage, and wherein at least a portion of the first leg is supported in the first guide groove and at least a portion of the second leg is supported in the second guide groove.

5. The earring or brooch back according to claim 1, wherein the bottom shell is provided on the inner side thereof with at least one protruding positioning part for positioning the at least one spring.

6. The earring or brooch back according to claim 1, wherein the first and second pressing element are each formed integrally.

7. The earring or brooch back according to claim 1, wherein the spring is a wire spring.

8. An earring or brooch back for receiving a post which is provided with at least one groove, comprising:

a housing comprising a bottom shell and a top shell, wherein the bottom shell and the top shell are provided with mutually aligned openings for forming a passage for the post;

a first and a second pressing element between the bottom shell and the top shell, wherein the first pressing element is provided with a first stop for the post and a first protruding part which protrudes from the housing, wherein the passage lies between the first stop and the first protruding part, and wherein the second pressing element is provided with a second stop for the post and with a second protruding part which protrudes from the housing, wherein the passage lies between the second stop and the second protruding part, wherein the first and second stop lie on either side of a post to be inserted; and at least one spring for spring-mounting the first and second pressing element;

wherein the bottom shell is formed on an inner side with a first internal guide part for guiding the first pressing element and with a second internal guide part for guiding the second pressing element, wherein the first and second internal guide part lie on either side of the passage for the post; and wherein the first internal guide part has a first guide wall which is parallel to a second guide wall of the second internal guide part, and wherein a direction of the first and second guide walls is parallel to a pressing direction in which the first and second pressing element are movable, said pressing direction extending between the first and second protruding part and being perpendicular to an axis of the passage.

9. The earring or brooch back according to claim 8, wherein the bottom shell, including the first and second internal guide part is formed integrally.

10. The earring or brooch back according to claim 8, wherein the spring is a wire spring.

11. An earring or brooch back for receiving a post which is provided with at least one groove, comprising:

a housing comprising a bottom shell and a top shell, wherein the bottom shell and the top shell are provided with mutually aligned openings for forming a passage for the post;

a first and a second pressing element between the bottom shell and the top shell, wherein the first pressing element is provided with a first stop for the post and a first protruding part which protrudes from the housing, wherein the passage lies between the first stop and the first protruding part, and wherein the second pressing element is provided with a second stop for the post and with a second protruding part which protrudes from the housing, wherein the passage lies between the second stop and the second protruding part, wherein the first and second stop lie on either side of a post to be inserted; and a single spring for spring-mounting the first and second pressing element; wherein the spring has a first spring-mounted leg and a second spring-mounted leg extending substantially along a V-shape or a U-shape around the passage;

wherein the first and the second pressing element are provided with, respectively at least a first and a second guide wall against which the first spring-mounted leg and the second spring-mounted leg act for the purpose of pressing respectively the first and second protruding part outward, and wherein the bottom shell is formed on an inner side with a first internal guide part for guiding the first pressing element and with a second internal guide part for guiding the second pressing element, wherein the first and second internal guide part lie on either side of the passage for the post.

12. The earring or brooch back according to claim 11, wherein the spring is a wire spring.

13. The earring or brooch back according to claim 12, wherein a diameter of the wire spring is smaller than 1 millimetre.

14. The earring or brooch back according to claim 11, wherein the first guide wall lies substantially between the passage and the first protruding part and the second guide wall lies substantially between the passage and the second protruding part, such that the distance between the first stop and the second stop can be increased by pressing the first and second protruding part inward.

15. The earring or brooch back according to claim 11, wherein the first pressing element comprises a first U-shaped part which extends substantially U-shaped around the passage with a first leg which forms the first stop, and wherein the second pressing element comprises a second U-shaped part which extends substantially U-shaped around the passage with a second leg which forms the second stop, wherein the first leg lies partially in the first U-shaped part of the second pressing element and the second leg lies partially in the second U-shaped part of the first pressing element.

16. The earring or brooch back according to claim 11, wherein the first internal guide part has a first guide wall which is parallel to a second guide wall of the second internal guide part, and wherein a direction of the first and second guide walls is parallel to a pressing direction in which the first and second pressing element are movable, said pressing direction being perpendicular to an axis of the passage.

17. The earring or brooch back according to claim 11, wherein the bottom shell is provided with a first and a second stepped peripheral part on which the top shell is mounted, wherein the first and second pressing element extend between the first and second stepped peripheral part.

18. The earring or brooch back according to claim 11, wherein the bottom shell is provided on the inner side thereof with at least one protruding positioning part for positioning the spring.

19. The earring or brooch back according to claim 18, wherein the bottom shell including the first and second internal guide part and the positioning part is formed integrally.

* * * * *